US009949577B2

(12) United States Patent
Botta et al.

(10) Patent No.: US 9,949,577 B2
(45) Date of Patent: Apr. 24, 2018

(54) PRODUCT DISPLAY UNIT INCLUDING WIDTH EXTENSION

(71) Applicant: Display Technologies, LLC, Lake Success, NY (US)

(72) Inventors: Michael A. Botta, Ridge, NY (US); Andrew Howard, Mamaroneck, NY (US); Stephen J. Cress, Baltimore, MD (US); Marty Illers, Yonkers, NY (US)

(73) Assignee: Display Technologies LLC, Lake Success, NY (US)

( * ) Notice: Subject to any disclaimer, the term of this patent is extended or adjusted under 35 U.S.C. 154(b) by 26 days.

(21) Appl. No.: 15/137,321

(22) Filed: Apr. 25, 2016

(65) Prior Publication Data

US 2016/0309920 A1 Oct. 27, 2016

Related U.S. Application Data

(60) Provisional application No. 62/152,287, filed on Apr. 24, 2015.

(51) Int. Cl.
*A47F 5/00* (2006.01)
*A47F 1/12* (2006.01)

(52) U.S. Cl.
CPC ..... *A47F 5/0068* (2013.01); *A47F 1/12* (2013.01)

(58) Field of Classification Search
CPC .... A47F 1/00; A47F 3/08; A47F 5/005; A47F 5/16
USPC ..... 108/60.61; 211/59.2, 184, 183, 126.1, 211/90.01, 94.01, 88.01, 88.02
See application file for complete search history.

(56) References Cited

U.S. PATENT DOCUMENTS 2,987,194 A * 6/1961 Burge ..... A47F 7/0028 211/126.1
4,685,574 A 8/1987 Young et al.
4,730,741 A * 3/1988 Jackle, III ..... A47F 1/126 211/59.3
4,763,963 A 8/1988 Lauffer et al.
4,785,945 A 11/1988 Rowse et al.
5,240,126 A 8/1993 Foster et al.
5,531,336 A 7/1996 Parham et al.
5,624,042 A * 4/1997 Flum ..... A47F 1/12 211/126.1
5,634,564 A 6/1997 Spamer et al.
5,685,664 A 11/1997 Parham et al.
5,806,690 A 9/1998 Johnson et al.
6,082,556 A 7/2000 Primiano et al.
(Continued)

OTHER PUBLICATIONS

International Search Report PCT/US14/55299 dated Dec. 19, 2014.

*Primary Examiner* — Jose V Chen
(74) *Attorney, Agent, or Firm* — Carter, DeLuca, Farrel & Schmidt, LLP

(57) ABSTRACT

A product display unit including a width extension includes a first lateral sidewall, a second lateral sidewall, and a track. The first lateral sidewall is configured to releasably engage a sidewall of a product display member. The second lateral sidewall includes a first segment, a second segment, and a third segment. The second segment is parallel to the first lateral sidewall. The first segment is disposed at an angle with respect to the second segment. The third segment is disposed at an angle with respect to the second segment. The track is disposed between the first lateral sidewall and the second lateral sidewall. The track is configured to support products thereon.

20 Claims, 9 Drawing Sheets

(56) References Cited

U.S. PATENT DOCUMENTS

| | | | | |
|---|---|---|---|---|
| 6,142,316 | A | 11/2000 | Harbour et al. | |
| 6,237,784 | B1 * | 5/2001 | Primiano | A47F 1/12 211/59.2 |
| 6,276,538 | B1 | 8/2001 | Battaglia et al. | |
| 6,325,221 | B2 * | 12/2001 | Parham | A47F 1/12 211/183 |
| 6,695,152 | B1 * | 2/2004 | Fabrizio | A47F 1/12 211/175 |
| 6,715,621 | B2 | 4/2004 | Boron | |
| 6,719,152 | B1 | 4/2004 | Nagel et al. | |
| 6,739,461 | B1 * | 5/2004 | Robinson | A47F 1/12 211/175 |
| 7,419,062 | B2 * | 9/2008 | Mason | A47F 1/126 211/59.3 |
| 7,448,504 | B2 * | 11/2008 | Primiano | A47F 1/12 108/107 |
| 7,681,744 | B2 | 3/2010 | Johnson | |
| 7,690,519 | B2 | 4/2010 | Kahl et al. | |
| 7,823,734 | B2 | 11/2010 | Hardy | |
| 7,854,333 | B2 | 12/2010 | Kottke et al. | |
| 8,056,734 | B2 | 11/2011 | Menz et al. | |
| 8,162,154 | B2 | 4/2012 | Trulaske, Sr. | |
| 8,312,999 | B2 | 11/2012 | Hardy | |
| 8,360,253 | B2 | 1/2013 | Hardy | |
| 8,469,205 | B1 | 6/2013 | Hardy | |
| 8,550,262 | B2 | 10/2013 | Hardy | |
| 8,739,984 | B2 | 6/2014 | Hardy | |
| 8,863,963 | B2 | 10/2014 | Hardy | |
| 9,107,516 | B2 | 8/2015 | Pichel | |
| 9,392,884 | B2 * | 7/2016 | Juric | A47F 1/126 |
| 2004/0020877 | A1 | 2/2004 | Boron | |
| 2004/0065631 | A1 | 4/2004 | Nagel | |
| 2004/0099619 | A1 * | 5/2004 | Bustos | A47F 5/01 211/59.2 |
| 2011/0094980 | A1 * | 4/2011 | Cousin | A47F 5/005 211/59.2 |
| 2012/0266437 | A1 * | 10/2012 | Camello | A47F 1/125 29/428 |

* cited by examiner

PRODUCT DISPLAY UNIT INCLUDING WIDTH EXTENSION

CROSS-REFERENCE TO RELATED APPLICATION

The present application claims priority to, and the benefit of, U.S. Provisional Patent Application Ser. No. 62/152,287 filed on Apr. 24, 2015, the entire contents of which being herein incorporated by reference in its entirety.

BACKGROUND

The present disclosure relates to a product display unit, and more particularly, to a product display unit having a lateral or width extension configured to increase the width of the product display unit.

Various types of product display units and merchandisers are commonly used in retail environments to display different types of products. As opposed to simply positioning products on shelves, product display units are commonly used to position products on a shelf in manner which automatically advances (e.g., via gravity or a pusher) a trailing or distal product (i.e., a product that is behind a lead or proximal-most product) closer to a consumer once the lead product has been removed from the shelf. As can be appreciated, such product display units facilitate the arrangement and upkeep of products, as the trailing products do not have to be manually moved toward the front of the shelf, for instance.

Additionally, in retail environments, for example, floor space, shelf space, and space in cold vaults is limited, and retailers typically attempt to maximize the amount of products they can store/display in their retail space. Further, retailers and other users of product display units often use products display units of different sizes to fit on a variety of types and sizes of shelves and cabinets, for example. Such users of product display units must typically stock a variety of sizes of display units to ensure they have enough product display units to accommodate displaying a variety of goods.

Further, when display units are used in on shelves supported by uprights, for example, the space in between the proximal and distal uprights is not typically occupied by any product display unit and thus lacks the ability to store/display products.

Accordingly, it is often desirable for retailers to display products in as many viewable and reachable places as possible, while still allowing the products to automatically advance toward the proximal portion of the shelf. It is also desirable for retailers to be able to use product display units on a variety of sizes of shelves without the need to stock different sizes of product display units. Further, it is often desirable to use the space between proximal and distal shelf supports.

SUMMARY

The present disclosure relates to a product display unit including a width extension. The product display unit including a width extension includes a first lateral sidewall, a second lateral sidewall, and a track. The first lateral sidewall is configured to releasably engage a sidewall of a product display member. The second lateral sidewall includes a first segment, a second segment, and a third segment. The second segment is parallel to the first lateral sidewall. The first segment is disposed at an angle with respect to the second segment. The third segment is disposed at an angle with respect to the second segment. The track is disposed between the first lateral sidewall and the second lateral sidewall. The track is configured to support products thereon.

In disclosed embodiments, the first segment may define a first angle with respect to the second segment, and the third segment may define a second angle with respect to the second segment. It is further disclosed that the first angle may be between about 15° and about 45°. Additionally, it is disclosed that the first angle may be equal to the second angle. It is also disclosed that the first angle may be different from the second angle. In embodiments, the second angle may be about 90°. It is further disclosed that the first angle may be between about 15° and about 45°. Additionally, it is disclosed that the first segment may be disposed adjacent a proximal portion of the track.

In disclosed embodiments, the track may include a main portion and an extension portion disposed laterally adjacent part of the main portion, each of the main portion and the extension portion may be configured to support a row of products thereon such that the track is configured to support two rows of products thereon.

The present disclosure also relates to a product display kit including a product display member and a product display unit including a width extension. The product display member includes a track for supporting a plurality of products. A first sidewall is disposed adjacent a first lateral side of the track of the product display member, and a second sidewall disposed adjacent a second lateral side of the track of the product display member. The product display unit including a width extension includes a first lateral, a second lateral sidewall, and a track. The first lateral sidewall configured to engage the first sidewall of the product display member. The second lateral sidewall includes a first segment, a second segment, and a third segment. The second segment is parallel to the first lateral sidewall, the first segment is disposed at an angle with respect to the second segment, and the third segment is disposed at an angle with respect to the second segment. The track of the product display unit including a width extension is disposed between the first lateral sidewall and the second lateral sidewall, and is configured to support products thereon.

In disclosed embodiments, the first segment may define a first angle with respect to the second segment, and the third segment may define a second angle with respect to the second segment. It is further disclosed that the first lateral sidewall may be configured to separately engage both of the first sidewall of the product display member and the second sidewall of the product display member. In embodiments, the first angle may be between about 15° and about 45°. It is also disclosed that the first angle may be equal to the second angle. It is further disclosed that the first angle may be different from the second angle. In embodiments, the second angle may be about 90°. Additionally, it is disclosed that the first angle may be between about 15° and about 45°. It is also disclosed that the first segment may be disposed adjacent a proximal portion of the track.

In disclosed embodiments, the track of the product display unit including a width extension may include a main portion and an extension portion disposed laterally adjacent part of the main portion. Each of the main portion and the extension portion may be configured to support a row of products thereon such that the track of product display unit including a width extension is configured to support two rows of products thereon.

The present disclosure also relates to a method of supporting products on a product display unit including a width extension. The method includes supporting a first product on a track in a first row of the product display unit including a width extension, and supporting a second product on the track in a second row of the product display unit including a width extension and in contact with the first product. The product display unit including a width extension includes a first lateral sidewall, and a second lateral sidewall. The second lateral sidewall includes a first segment, a second segment, and a third segment. The second segment is parallel to the first lateral sidewall. The first segment is disposed at an angle with respect to the second segment. The third segment is disposed at an angle with respect to the second segment.

BRIEF DESCRIPTION OF THE DRAWINGS

Embodiments of the present disclosure are described hereinbelow with reference to the drawings wherein.

DETAILED DESCRIPTION

Figure 1:
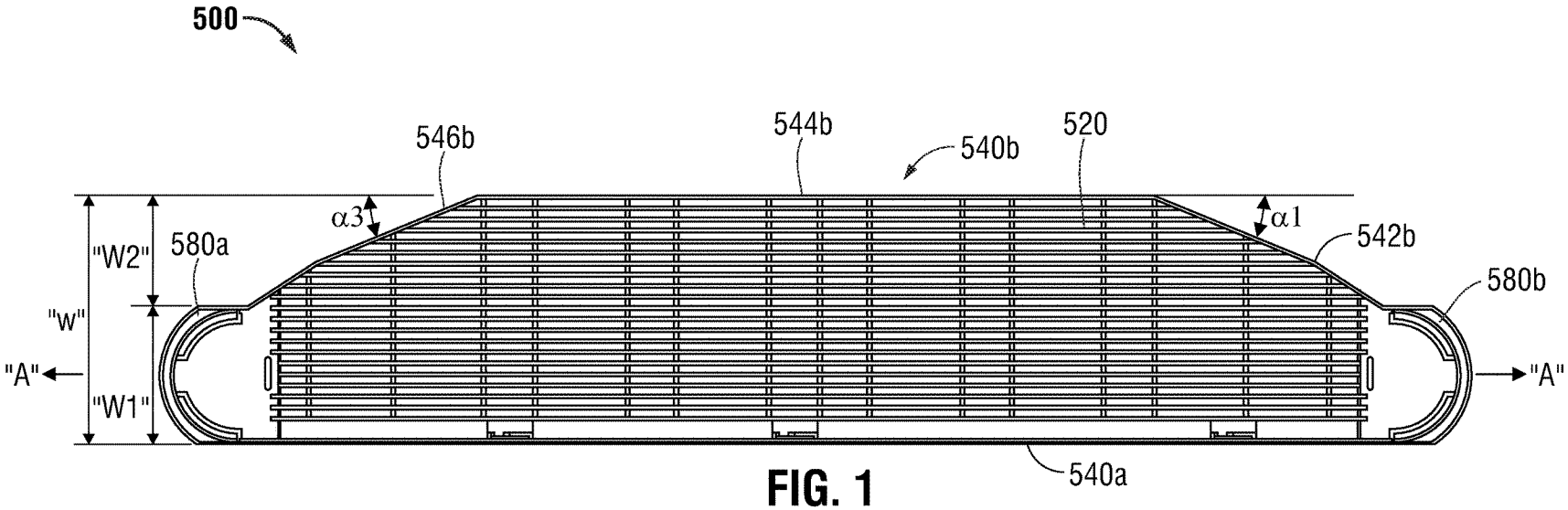
FIG. 1 is a top view of a product display unit including a width extension in accordance with embodiments of the present disclosure.

Embodiments of the presently disclosed product display unit and width extension are now described in detail with reference to the drawings, in which like reference numerals designate identical or corresponding elements in each of the several views. As used herein the term "distal" refers to that portion of the product display unit, width extension, or component thereof, farther from a user (e.g., customer), while the term "proximal" refers to that portion of the product display unit, width extension, or component thereof, closer to the user.

Figure 2:
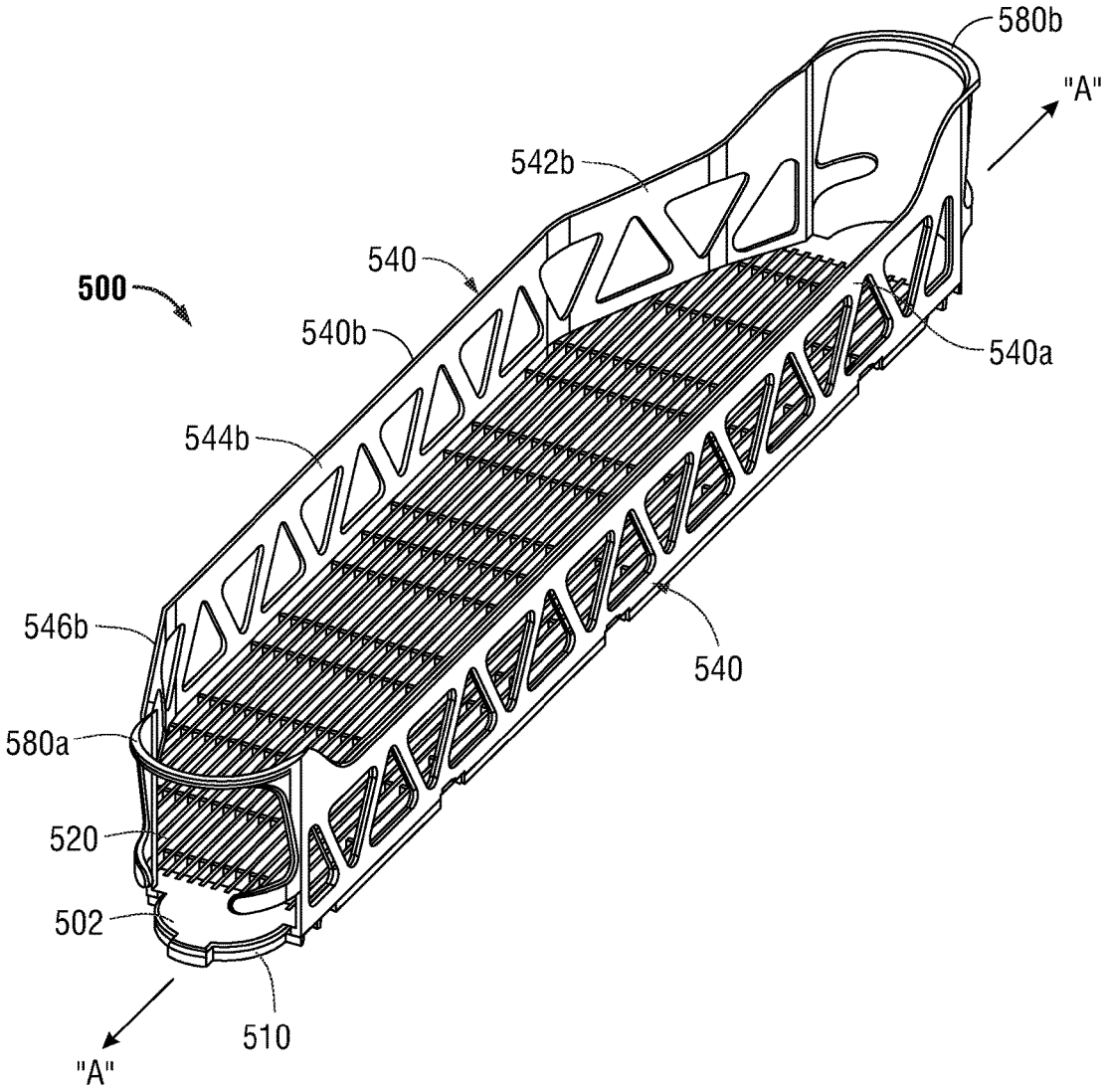
FIG. 2 is a perspective view of the product display unit shown in FIG. 1.
Figure 3:
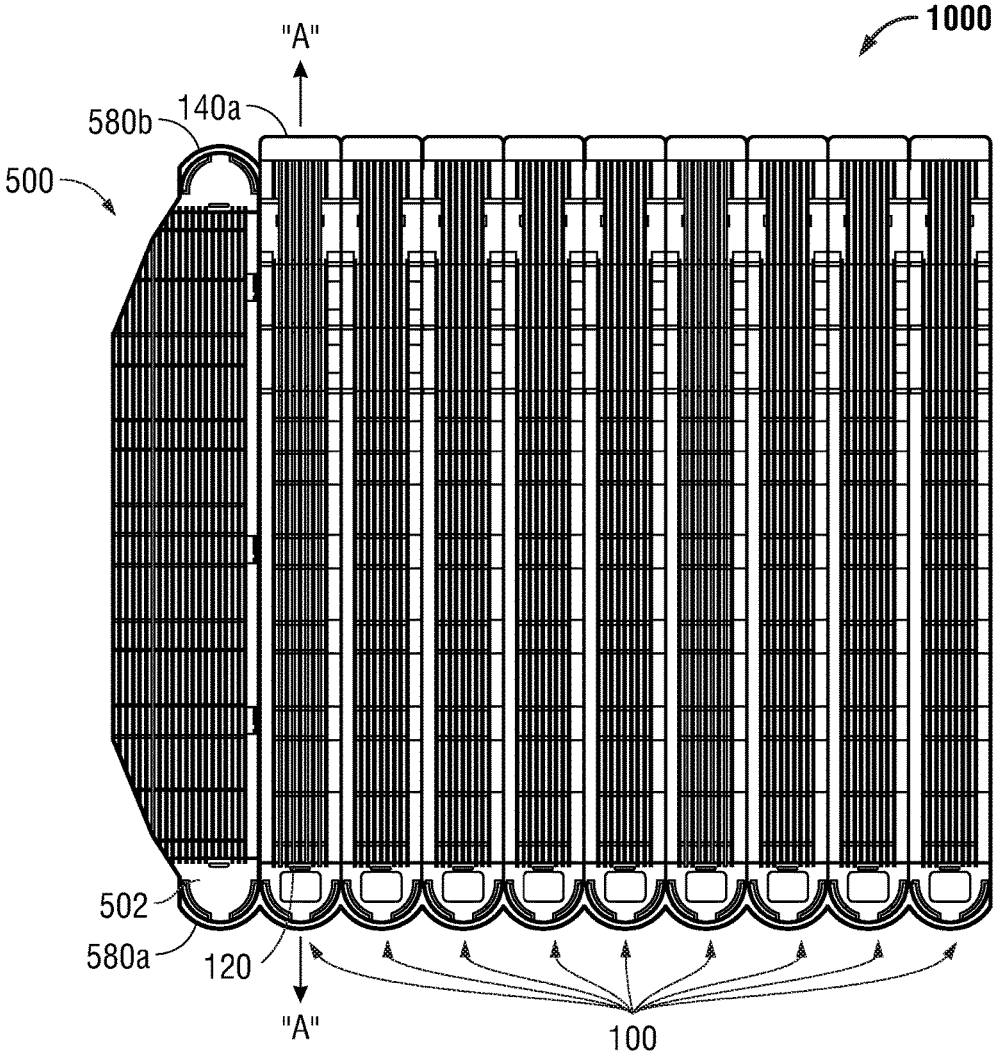
FIG. 3 is a top view of the product display unit of FIGS. 1 and 2 engaged with a product display assembly.
Figure 4:
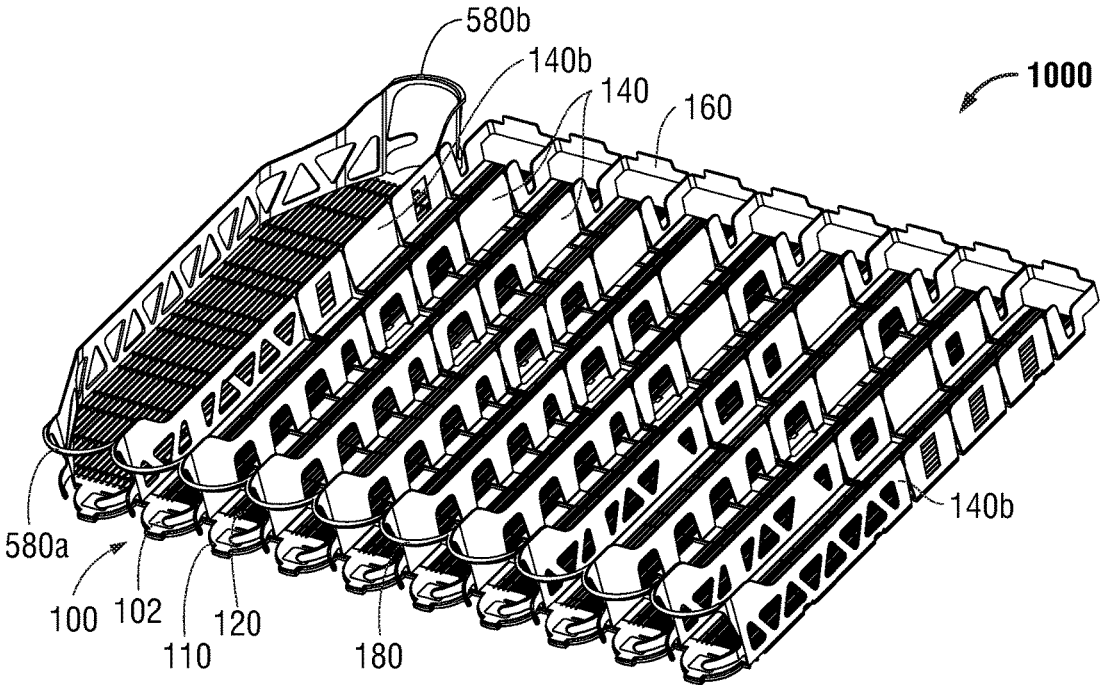
FIG. 4 is a perspective view of the product display unit engaged with the product display assembly of FIG. 3.
Figure 5:
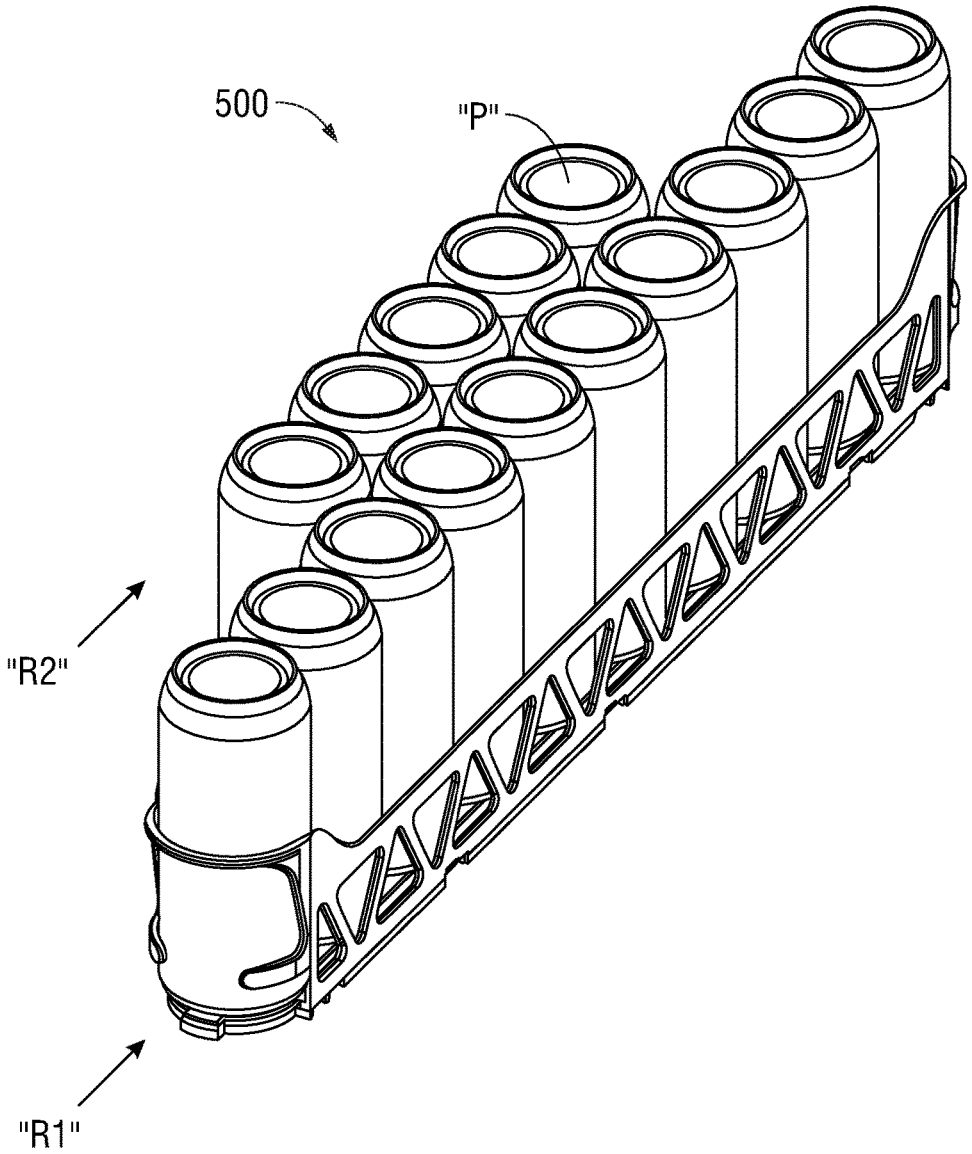
FIG. 5 is a perspective view of the product display unit of FIG. 2 shown with a plurality of products thereon.

An embodiment of a product display unit including a width extension is illustrated in FIGS. 1-8 and is generally referenced by numeral 500. An embodiment of a product display assembly is illustrated in FIGS. 3, 4, 7 and 8 and is generally referenced by numeral 1000. Product display assembly 1000 includes a plurality (e.g., nine) of product display members 100 (FIG. 3). Each product display member 100 includes a base 102, a bottom member 110, a track 120, sidewalls 140, a distal member 160, and a proximal member 180 (FIG. 4).

Figure 7:
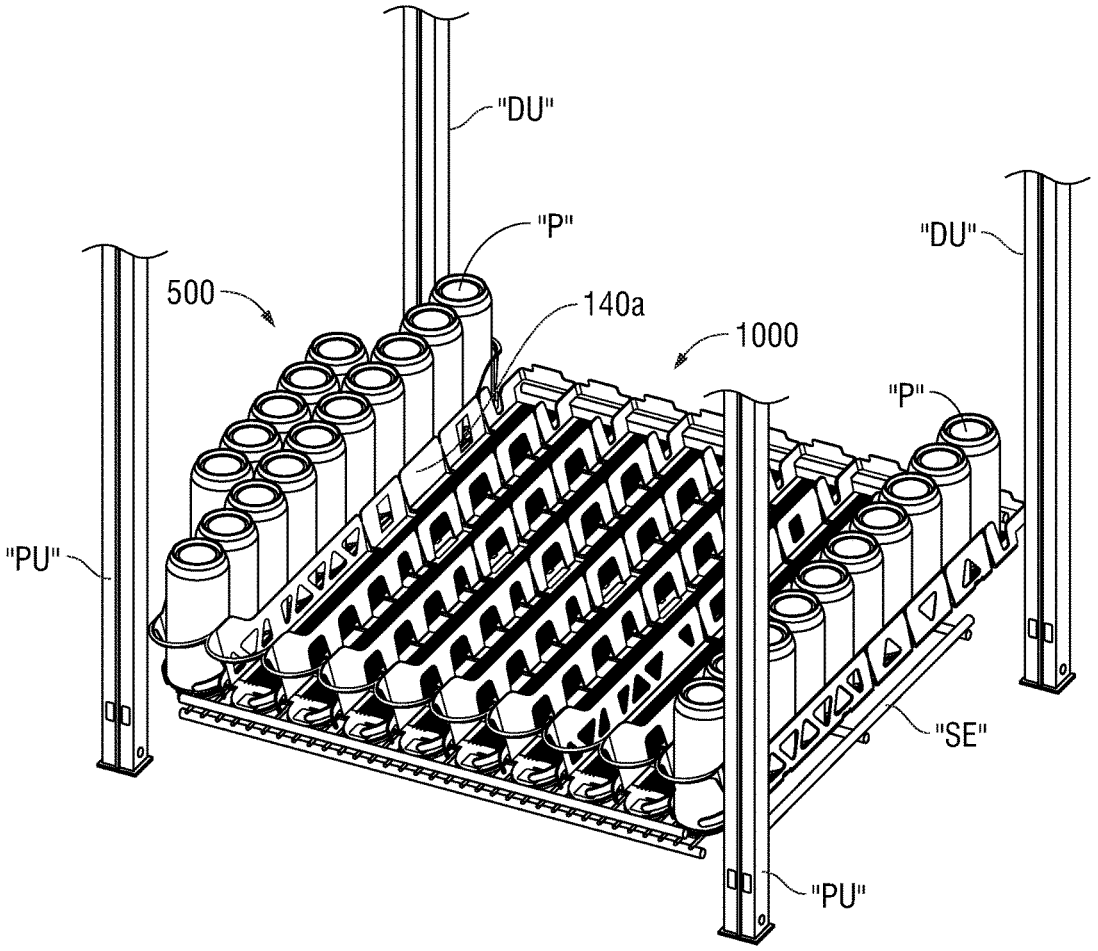
FIG. 7 is a perspective view of the product display unit of FIG. 5 having a plurality of products thereon, engaged with the product display assembly of FIGS. 3 and 4, and shown supported by a shelf and uprights.
Figure 8:
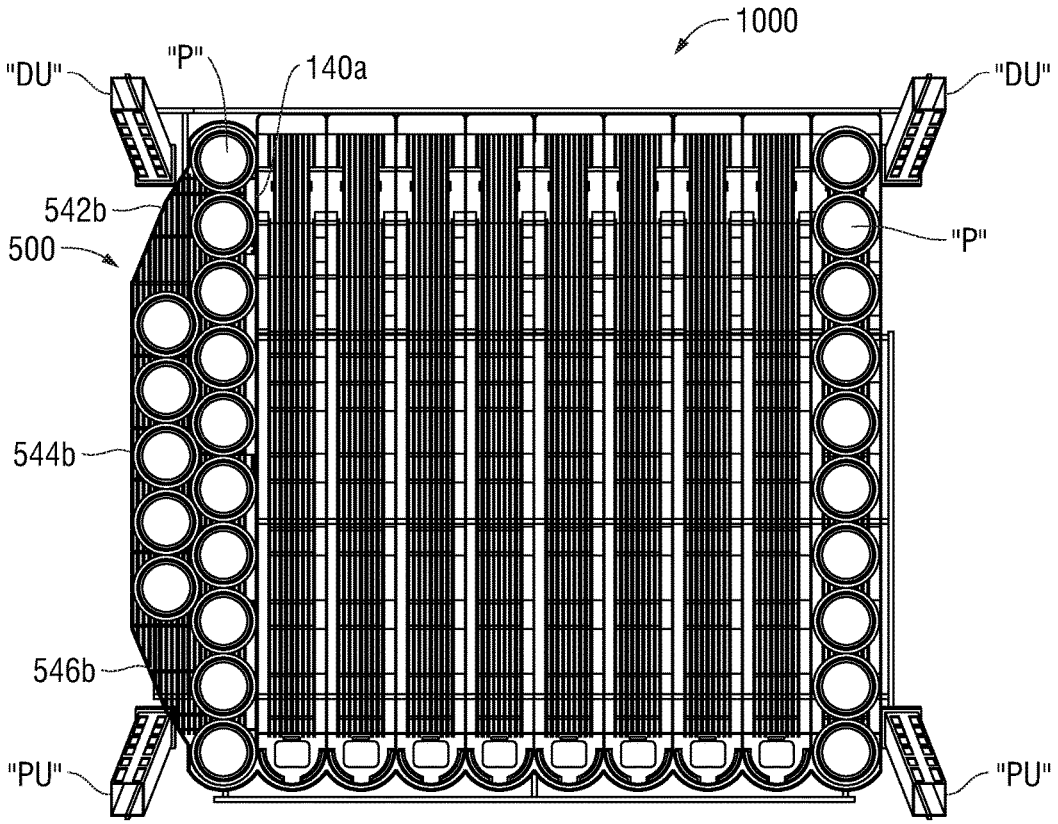
FIG. 8 is a top view of the product display unit, product display assembly, products, shelf and uprights of FIG. 7.

The track 120 includes a product-supporting surface and is configured to slidably support a plurality of products "P" thereon (FIGS. 7-8). That is, products "P" are slidable along the track 120. For example, gravity urges products to slide along the track 120 in a distal-to-proximal direction. In such gravity feed arrangements, a distal portion of the track is elevated with respect to a proximal portion of the track, such that gravity urges the products toward proximal member 180. With particular reference to FIG. 3, the track 120 defines a longitudinal axis "A-A."

The sidewalls 140 are disposed at both lateral sides of the track 120 and are configured to help maintain products on the track 120. As shown in FIGS. 3 and 4, for example, when a plurality of product display members 100 is positioned adjacent one another to form product display assembly 1000, adjacent product display members 100 share common sidewalls 140. Alternatively, each product display member 100 may include a pair of sidewalls 140 such that, when connected to another product display member 100, the sidewalls 140 are in an abutting relationship.

The proximal member 180 is positioned adjacent the front or proximal portion of the track 120 and is configured to help maintain products "P" on the track 120. More specifically, the proximal member 180 helps prevent a proximal-most product from falling proximally off of the track 120. Additionally, the proximal member 180 opposes the gravitational force and/or the force supplied by a pusher (not shown). Further, while the illustrated embodiments include a certain type of proximal member 180, the present disclosure includes the use of any suitable type and number of proximal members 180 per product display member 100.

The distal member 160 is configured to help maintain products "P" on track 120. More particularly, the distal member 160 is configured to help prevent a distal-most product from falling distally off of the track 120.

Product display unit including width extension 500 is configured to engage a sidewall 140 of a product display member 100. More particularly, product display unit including width extension 500 is configured to separately engage (e.g., releasably engage) a first lateral sidewall **140*a* and a second lateral sidewall 140*b* of product display members 100 of product display assembly 1000. Various types of mechanical structures (e.g., snap-fit connections, etc.) are contemplated for releasably engaging product display unit including width extension 500 and product display assembly 1000. Additionally, product display unit including width extension 500 is configured to be supported by a shelf extension "SE" that extends laterally outward of product display assembly 1000 (see FIG. 7 which shows the shelf extension "SE" on the opposite side as product display unit including width extension 500**, for clarity).

Product display unit including width extension 500 includes a base 502, a bottom member 510, a track 520, sidewalls 540, and two stop members **580*a*, 580*b*. When product display unit including width extension 500 is engaged with first sidewall 140*a* of product display assembly 1000 (FIGS. 3 and 4), first stop member 580*a* is disposed at a proximal portion of base 502 and second stop member 580*b* is disposed at a distal portion of base 502; when product display unit including width extension 500 is engaged with second sidewall 140*b* of product display assembly 1000, second stop member 580*b* is disposed at a proximal portion of base 502 and first stop member 580*a* is disposed at a distal portion of base 502**.

With particular reference to FIGS. 1 and 2, a first lateral sidewall **540*a* of product display unit including width extension 500 is linear, and a second lateral sidewall 540*b* includes three segment—a first segment 542*b*, a second segment 544*b*, and a third segment 546*b*. As shown, second segment 544*b* is parallel to first lateral sidewall 540*a* and parallel to the longitudinal axis "A-A." Each of the first segment 542***b* and the second segment 546*b* is disposed at a non-parallel angle with respect to the second segment 544*b*, and with respect to the longitudinal axis "A-A." In particular, first segment 542*b* is disposed at a first angle α1 with respect to second segment 544*b*, and third segment 546*b* is disposed at a second angle α2 with respect to second segment 544*b*. It is envisioned that each of angles α1 and α2 is between about 15° and about 45°, for example. Smaller or greater angles are also contemplated.

It is further envisioned that an angle is formed within each of first segment 542*b* and third segment 546*b*, thus creating proximal and distal portions of each segment 542*b*, 546*b* separated by a curve, point or angle. It is also disclosed that first segment 542*b* and third segment 546*b* are mirror images of each other (facilitating the ability to engage product display unit including width extension 500 on either side of product display assembly 1000), include more than one linear section, and/or include an arcuate portion (e.g., when viewed from above).

In embodiments where product display unit including width extension 500 is engaged with first sidewall 140*a* of product display assembly 1000 (FIGS. 3, 4, 7 and 8), first segment 542*b* of second lateral sidewall 540*b* is configured to direct products "P" away from a distal upright "DU" (FIGS. 7 and 8); the angled orientation of third segment 546*b* ensures products "P" do not interfere a proximal upright "PU." In embodiments where product display unit including width extension 500 is engaged with second sidewall 140*b* of product display assembly 1000 (not shown), third segment 546*b* of second lateral sidewall 540*b* is configured to direct products "P" away from a proximal upright "PU"; the angled orientation of first segment 542*b* ensures products "P" do not interfere a distal upright "DU."

Figure 6:
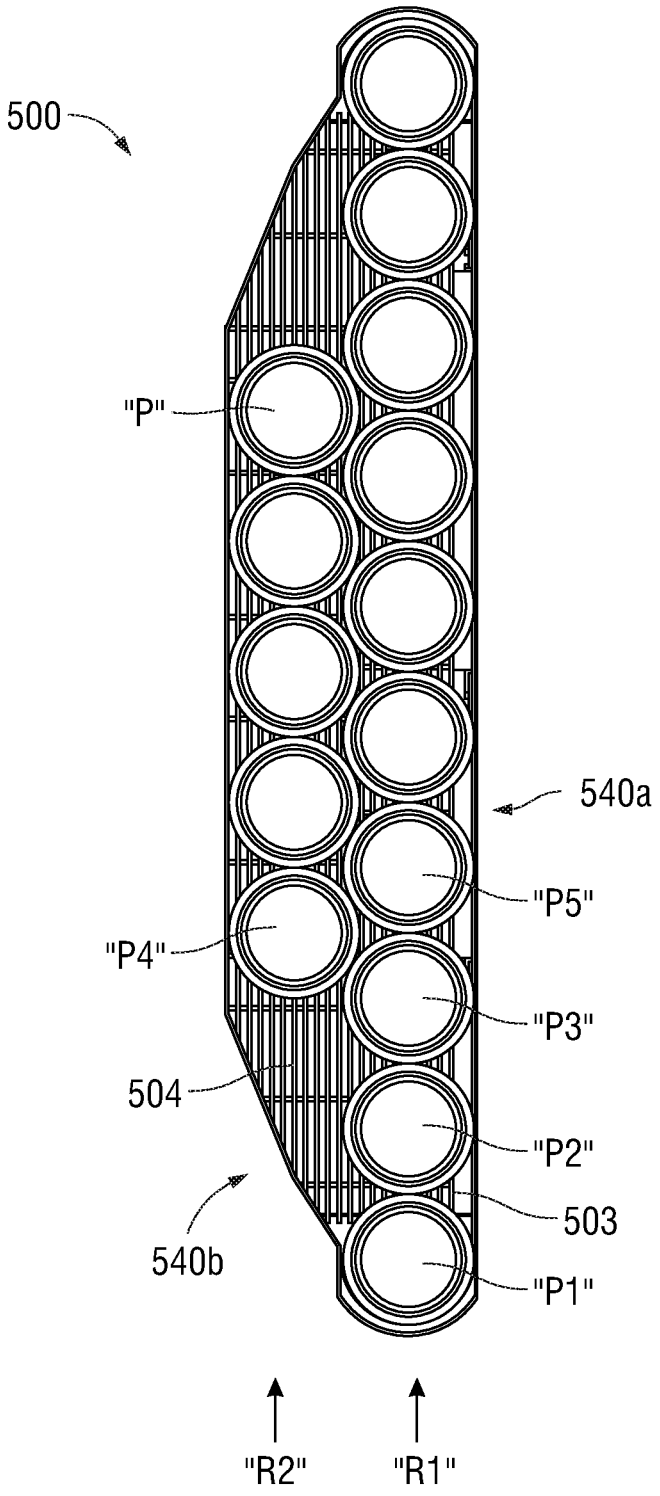
FIG. 6 is a top view the product display unit and products of FIG. 5.

The orientation of second lateral sidewall 540*b* of product display unit including width extension 500 dictates the size and the shape of the track 520. As can be appreciated, the track 520 of the width extension 500 can support more products "P" than the track 120 of a traditional product display member 100 as the track 520 includes a greater surface area than track 120. With particular reference to FIGS. 5-8, product display unit including width extension 500 is configured to support a plurality of products "P," including a plurality of staggered products "P" thereon. A first row "R1" of products "P" is supported by a main portion 503 of product display unit including width extension 500, and a second row "R2" of products "P" is supported by an extension portion 504 (FIG. 6). The staggered orientation of the products "P" in addition to their proximity to each other causes products "P" to alternate as they move proximally. For instance, with continued reference to FIG. 6, after the first two products "P1" and P2" are removed from product display unit including width extension 500, third product "P3" (included in the first row "R1" will be the proximal-most product, and fourth product "P4" (included in the second row "R2") will move laterally from extension portion 504 onto main portion 503, and distally adjacent of third product "P3." Removal of third product "P3" causes fourth product "P4" to be the proximal-most product, etc. Thus, removing or shopping the proximal-most product "P" causes a product "P" in the extension portion 504 to move into the main portion 503.

Various sizes and distances of product display unit including width extension 500 are included and contemplated by the present disclosure. In the embodiment illustrated in FIG. 1, the width "w1" of main portion 503 of width extension 500 is the same as a width of product display member 100. The width "w2" of extension portion 504 of width extension is smaller than the width "w1" of the main portion 503, thus facilitating the staggered orientation of products "P" supported thereon. Moreover, a combined width "w" of the widest portion of product display unit including width extension 500 is smaller than the combined width of two products "P" configured to be supported thereon.

Additionally, while the illustrated embodiments show the extension portion 504 of product display unit including width extension 500 supporting five products "P" thereon, the present disclosure also includes the extension portion 504 supporting more or fewer than five products "P" (e.g., by changing the angle/shape of the first segment 542*b* and/or the third segment 546*b*, or by changing the size/shape of the track 520).

Figure 9:
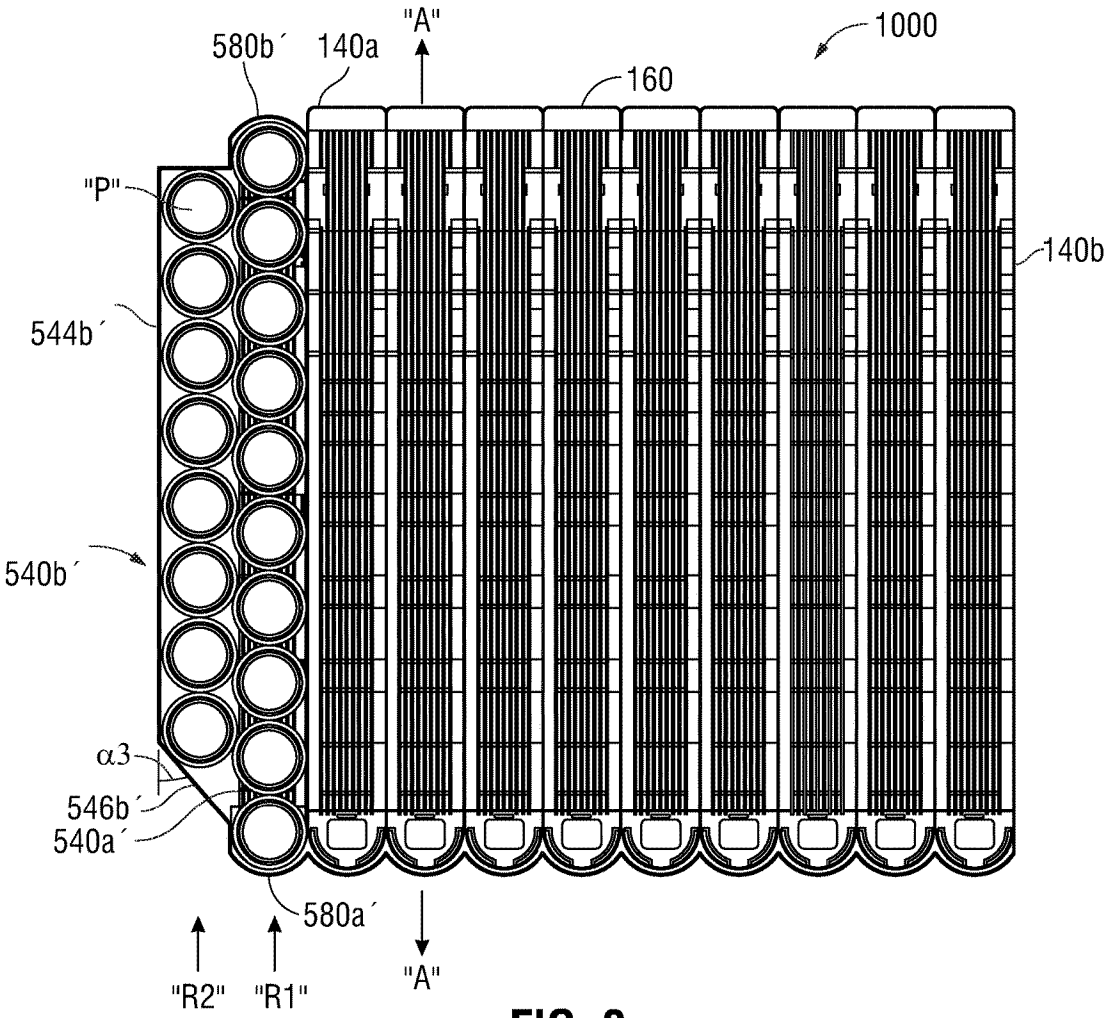
FIG. 9 is a top view of another embodiment of a product display unit having products thereon and engaged with a product display assembly.

With reference to FIG. 9, another embodiment of a product display unit including width extension is shown and is generally referred to as reference character 500' herein. Many features of product display unit including width extension 500' are similar to those of product display unit including width extension 500 and will not be further discussed herein. Additionally, in the present disclosure when reference is made to product display unit including width extension 500, product display unit including width extension 500' is also included, where appropriate.

Product display unit including width extension 500' is configured to mechanically one lateral sidewall (e.g., 140*a*) of product display member 100 of product display assembly 1000. Product display unit including width extension 500' includes a first sidewall 540*a'* and a second sidewall 540*b'*. Second sidewall 540*b'* includes a first segment 542*b'*, a second segment 544*b'*, and a third segment 546*b'*. First segment 542*b'* is perpendicular or substantially perpendicular to the longitudinal axis "A-A." Second segment 544*b'* is parallel to the longitudinal axis "A-A." Third segment 546*b'* is disposed at an angle α3 with respect to the second segment 544*b'*. It is envisioned that α3 is between about 15° and about 45°. Other angles are also envisioned. This configuration of sidewall 540*b'* allows more products "P" in the second row "R2" with respect to product display unit including width extension 500 and its sidewall 540. As can be appreciated, a mirror image of product display unit including width extension 500' can be used to mechanically engage the other lateral sidewall (e.g., 140*b*) of product display member 100 of product display assembly 1000.

Additionally, while product display unit including width extension 500' includes a first stop member 580*a'* and a second stop member 580*b'*, it is envisioned that second stop member 580*b'* is a distal member similar to distal member 160 of product display member 100.

The present disclosure also relates to a product display kit including the product display assembly 1000, and at least one product display unit including width extension 500, 500'. It is further envisioned that the product display kit includes a plurality (e.g., two) of product display units including width extensions 500, 500' and/or product display unit including width extension 500, 500' having different main portions 503 having different widths "w1" from each other, and/or extension portions 504 having different widths "w2" from each other. As can be appreciated, such product display kits enable retailers a great amount of flexibility with regards to how the space between various proximal and distal uprights can be utilized.

Further, while the accompanying figures illustrate a particular number of product display members 100 disposed adjacent each other, it is envisioned and within the scope of the present disclosure to include more or fewer amounts of product display members 100, and to include product display members 100 of other sizes, and disposed at different angles than those illustrated, for example. Additionally, the present disclosure contemplates the use of a pusher assembly to urge products proximally on the track 120, 520 (e.g., when the slope of the shelf supporting the product display member 100 is insufficient to urge the products proximally via gravity).

The present disclosure also includes methods of using product display unit including width extension 500. Methods include supporting products "P" in two rows of product display unit including width extension 500—a first row "R1" of products "P" being supported by main portion 503, and a second row "R2" of products "P" being supported by extension portion 504. The greatest width "w" of product display unit including width extension 500 is less than the combined width of two products "P" (one product "P" from the first row "R1," and one product "P" from the second row "R2") supported thereon. As shown in FIGS. 6, 8 and 9, for example, these widths help ensure the products "P" are arranged in a staggered configuration.

Further details of related product display units are described in commonly-owned U.S. Pat. No. 5,645,176, which issued on Jul. 8, 1997, the entire contents of which being incorporated by reference herein.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended hereto.

The invention claimed is:

1. A product display unit including a width extension, comprising:

a first lateral sidewall configured to releasably engage a sidewall of a product display member;

a second lateral sidewall including a first segment, a second segment, and a third segment, the second segment being parallel to the first lateral sidewall, the first segment being disposed at an angle with respect to the second segment, and the third segment being disposed at an angle with respect to the second segment; and a track disposed between the first lateral sidewall and the second lateral sidewall, the track configured to support products thereon;

wherein a first portion of the product display unit including the width extension is configured to be supported by a shelf supported by a proximal upright and a distal upright, wherein a second portion of the product display unit including the width extension is configured to overhang a lateral edge of the shelf, and wherein part of the second portion of the product display unit including the width extension is configured for positioning laterally of the lateral edge of the shelf and between the proximal upright and the distal upright.

2. The product display unit including a width extension according to claim 1, wherein the first segment defines a first angle with respect to the second segment, and wherein the third segment defines a second angle with respect to the second segment.

3. The product display unit including a width extension according to claim 2, wherein the first angle is between about 15° and about 45°.

4. The product display unit including a width extension according to claim 3, wherein the first angle is equal to the second angle.

5. The product display unit including a width extension according to claim 2, wherein the first angle is different from the second angle.

6. The product display unit including a width extension according to claim 5, wherein the second angle is about 90°.

7. The product display unit including a width extension according to claim 6, wherein the first angle is between about 15° and about 45°.

8. The product display unit including a width extension according to claim 1, wherein the first segment is disposed adjacent a proximal portion of the track, wherein the second segment is disposed adjacent a distal portion of the track, and wherein the track extends between a proximal portion of the first lateral sidewall and a distal portion of the first lateral sidewall.

9. The product display unit including a width extension according to claim 1, wherein the track includes a main portion and an extension portion disposed laterally adjacent part of the main portion, each of the main portion and the extension portion is configured to support a row of products thereon such that the track is configured to support two rows of products thereon.

10. A product display kit, comprising:

a product display member including a track for supporting a plurality of products, a first sidewall disposed adjacent a first lateral side of the track of the product display member, and a second sidewall disposed adjacent a second lateral side of the track of the product display member, the product display member configured for positioning on a shelf which is supported by a proximal upright and a distal upright; and a product display unit including a width extension, including:

a first lateral sidewall configured to engage the first sidewall of the product display member;

a second lateral sidewall including a first segment, a second segment, and a third segment, the second segment being parallel to the first lateral sidewall, the first segment being disposed at an angle with respect to the second segment, and the third segment being disposed at an angle with respect to the second segment; and a track disposed between the first lateral sidewall and the second lateral sidewall, the track of the product display unit including the width extension configured to support products thereon, wherein a first portion of the product display unit including the width extension is configured to overhang a lateral edge of the shelf, and wherein part of the first portion of the product display unit including the width extension is configured for positioning laterally of the lateral edge of the shelf and between the proximal upright and the distal upright.

11. The product display kit according to claim 10, wherein the first segment defines a first angle with respect to the second segment, and wherein the third segment defines a second angle with respect to the second segment.

12. The product display kit according to claim 11, wherein the first angle is between about 15° and about 45°.

13. The product display kit according to claim 11, wherein the first angle is different from the second angle.

14. The product display kit according to claim 13, wherein the second angle is about 90°.

15. The product display kit according to claim 14, wherein the first angle is between about 15° and about 45°.

16. The product display kit according to claim 11, wherein the first lateral sidewall is configured to separately engage both of the first sidewall of the product display member and the second sidewall of the product display member.

17. The product display kit according to claim 16, wherein the first angle is equal to the second angle.

18. The product display kit according to claim 10, wherein the first segment is disposed adjacent a proximal portion of the track, wherein the second segment is disposed adjacent a distal portion of the track, and wherein the track extends between a proximal portion of the first lateral sidewall and a distal portion of the first lateral sidewall.

19. The product display kit according to claim 10, wherein the track of the product display unit including the width extension includes a main portion and an extension portion disposed laterally adjacent part of the main portion, each of the main portion and the extension portion is configured to support a row of products thereon such that the track of product display unit including the width extension is configured to support two rows of products thereon.

20. A method of supporting products on a product display unit including a width extension, the product display unit including the width extension is configured to be supported by a shelf supported by a proximal upright and a distal upright, the method comprising:

supporting a first product on a track in a first row of the product display unit including the width extension; and supporting a second product on the track in a second row of the product display unit including the width extension and in contact with the first product, wherein the second row of the product display unit including the width extension overhangs a lateral edge of the shelf, and wherein the second product is positioned laterally of the lateral edge of the shelf and between the proximal upright and the distal upright;

wherein the product display unit including the width extension includes a first lateral sidewall, and a second lateral sidewall, the second lateral sidewall includes a first segment, a second segment, and a third segment, the second segment being parallel to the first lateral sidewall, the first segment being disposed at an angle with respect to the second segment, and the third segment being disposed at an angle with respect to the second segment.

* * * * *